US005282001A

United States Patent [19]

Watson

[11] Patent Number: 5,282,001

[45] Date of Patent: Jan. 25, 1994

[54] REPROGRAPHIC APPARATUS WITH OPERATING PARAMETERS VARIABLE ACCORDING TO SHEET CHARACTERISTICS

[75] Inventor: Peter R. Watson, Stevenage, United Kingdom

[73] Assignee: Xerox Corporation, Stamford, Conn.

[21] Appl. No.: 939,762

[22] Filed: Sep. 2, 1992

[30] Foreign Application Priority Data

Sep. 11, 1991 [GB] United Kingdom ..... 9119487

[51] Int. Cl.[5] ..... G03G 15/00

[52] U.S. Cl. ..... 355/208; 355/311

[58] Field of Search ..... 355/208, 311, 309, 317; 346/134; 395/111

[56] References Cited

U.S. PATENT DOCUMENTS 5,048,813 9/1991 Wierszewski et al. ..... 271/98
5,053,814 10/1991 Takano et al. ..... 355/208
5,067,835 11/1991 Yamamoto et al. ..... 355/311 X
5,099,287 3/1992 Sato ..... 355/208 X

FOREIGN PATENT DOCUMENTS 0212781 3/1987 European Pat. Off. .
0295969 12/1988 European Pat. Off. .

OTHER PUBLICATIONS

Xerox Disclosure Journal; vol. 15; No. 4, Jul./Aug. 1990; p. 265.

*Primary Examiner*—Joan H. Pendegrass

[57] ABSTRACT

A reprographic apparatus, such as, a copier or printer is controlled by a controller including a microprocessor and a memory, the apparatus including one or more sheet trays for supplying sheets which will receive images in use of the apparatus. One or more operating parameters of the apparatus, such as the timing of sheet feeding devices, or fuser temperature, are selectively variable in accordance with differing characteristics of sheets to be used. A set of values of the operating parameters are held in the memory for each kind of sheet, and the appropriate operating parameters are set to the values derived from the memory for a given sheet type. The sheet type, and hence the operating parameters, may be set by a local or remote user of the apparatus. Alternatively, the apparatus may include means associated with at least one of the trays for recognizing sheet characteristics and setting the operating parameters accordingly.

9 Claims, 1 Drawing Sheet

Figure 1:
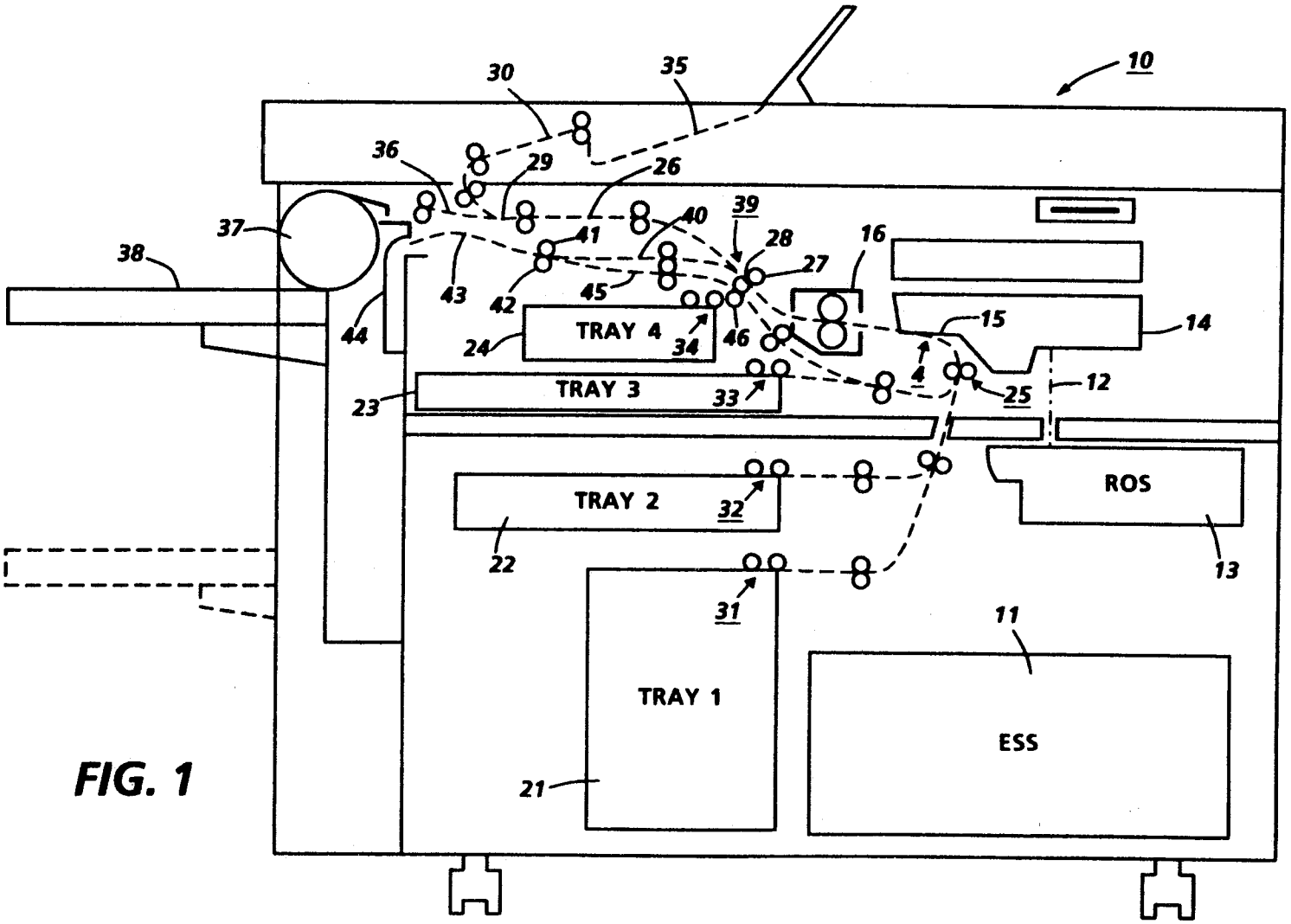

REPROGRAPHIC APPARATUS WITH OPERATING PARAMETERS VARIABLE ACCORDING TO SHEET CHARACTERISTICS

Hereby cross-referenced, and incorporated herein by reference, is the copending application of the same assignee, U.S. Ser. No. 07,938,746, entitled "ELECTROSTATIC REPRODUCTION MACHINE", by Nicholas Frank et al., filed concurrently herewith.

This invention relates to a reprographic apparatus, and is particularly concerned with the control of the operating parameters of such an apparatus.

It is known to provide reprographic apparatus, such as a xerographic copier or printer, with automatic control of certain machine operating parameters. Thus, for example, an automatic density control is known in which an image of a test patch of standard optical density is formed on a photoreceptor and developed like a normal image. The optical density of the developed test path is measured, and the appropriate machine operating parameters are automatically varied by the control system of the machine to bring the optical density of the test patch to, or within a desired range of, an optimum density.

It is also known to provide adjustable settings on a copier or printer whereby the operator can, when needed, alter for example the magnification setting of the machine, or alter the copy density by selecting an appropriate one of a series of 'copy darker' or 'copy lighter' buttons.

A known method for calibrating an air knife of a vacuum corrugation feeder using a non-volatile memory is disclosed in U.S. Pat. No. 5,048,813. An approach to improved paper handling hardware is shown in the Xerox Disclosure Journal, Vol. 15, No. 4, July/August 1990, pp 265 as incorporating optical bar codes on copy paper ream wrappers. The bar codes contain information pertaining to the paper basis weights, sizes and other stack parameters that are retrieved by a reading scan wand with transmission a controller for subsequent use in automatic subsystem setup, adjustment and print quality optimization.

Also, European Patent application 0 212 781 shows a sheet feeder control used in a reproduction machine that adjusts the copy sheet feeder of the machine automatically to compensate for wear on the feeder parts and in col. 7, lines 20–26 and col. 9, lines 26–35 point out the use of a non-volatile memory to determine the width of copy sheets in use. In European Patent Application 0 295 969 a control unit is shown for use in a paper feed control system for selecting an optimum loading feed speed from a plurality of predetermined programs stored in a memory, such as, ROM. All of the above-mentioned references are included herein to the extend necessary to practice the present invention.

Apart from the automatic or manual setting of specific operating parameters in these ways, it is usual for the majority of the machine operating parameters to be pre-set to standard settings, based on the most often used type of copy sheets, such as A4 sheets of 80 g. $m^{-2}$ white paper. If sheets of different feedstock, such as larger sheets, heavier sheets such as cardstock, or transparencies are used, the machine may not give optimum performance for those sheets.

It is an object of the present invention to optimize the performance of a reprographic machine for different feedstocks.

According to the present invention, there is provided a reprographic apparatus controlled by a controller including a microprocessor and a memory, the apparatus including one or more sheet trays for supplying sheets which will receive images in use of the apparatus, wherein one or more operating parameters of the apparatus are selectively variable in accordance with differing characteristics of sheets to be used, characterised in that a set of values of the operating parameters are held in the memory for each of a series of different kinds of sheet, and that means are provided for setting the appropriate operating parameters to the values derived from the memory in accordance with the sheet characteristics.

The setting means may be operable by the user of the apparatus, either locally, or, in the case of a remotely operated printer, from a remote location. Alternatively, the sheet trays may have associated with them means for recognising sheet characteristics and for operating the setting means to set the operating parameters appropriately.

The apparatus of the invention has the advantage that it enables the working latitude of a copier or printer to be extended.

An apparatus in accordance with the invention will now be described, by way of example, with reference to the accompanying drawings, in which:

FIG. 1 is a schematic diagram showing the main elements of a xerographic laser printer which suitably incorporates the control arrangements of the present invention.

Referring to FIG. 1, the main elements of a zerographic laser printer 10 are shown in diagrammatic form. The printer produces prints, or copies, of input information in electronic form, which may be derived from documents. The electronic input information, in digital form, is processed by an electronic sub-system (ESS) 11, and is used to modulate a scanning light beam 12, produced by a laser, in a raster output scanner (ROS) 13. The light beam 12, typically a laser beam, is directed onto a photoreceptor contained within a zerographic cassette 14. The photoreceptor is uniformly electrostatically charged and moved past a slit in the underside of the cassette 14. The beam 12 is scanned across the slit to form an electrostatic latent image on the photoreceptor by selectively discharging the uniform charge where light falls on it. The electrostatic latent image is developed with toner particles which adhere selectively to the latent image in the same configuration as the image, and the developed image is transferred, at transfer station 15, to a sheet of paper. The paper sheet, carrying the developed image, then passes through a fuser 16, consisting of a heated roller and a co-operating back-up roller, to fuse the image to the paper sheet, forming a permanent print or copy. The copy may then be transported into one of two output trays, as will be described in more detail below, or be returned, in a duplex imaging mode, to the xerographic cassette to receive a further developed image on its second side.

Paper sheets to receive the developed images are fed out of any one of four trays 21, 22, 23 and 24, with the different trays being capable of containing different sizes and different numbers of sheets. For example, tray 21 is a high capacity tray for containing the size of sheet most often used in the printer, for example A4 sheets. Trays 22 and 23 will accommodate larger sizes, and tray 24 may be used, for example, to contain special sheets such as coloured sheets or transparencies. Sheets are fed out of the trays 21, 22, 23 and 24 by respective sheet feeders 31, 32, 33 and 34, then by transport rollers through converging sheet paths until the sheet fed from any one of the four trays is feed by common fed roller pair 25 into the xerographic cassette 14 at transfer station 15. The sheet carrying the developed image then passes through fuser 16.

The further progress of a copy sheet through the machine depends on whether a simplex (one-sided) or duplex (two-sided) copy is being made. If a simplex copy is being made, the sheet follows upper paper path 26 after passing through transport rollers 27, 28. The sheet may then travel upwardly around sheet path 30, to be deposited in the top output tray 35, or it may proceed substantially horizontally along a path 36 to an inverter drum 37 before being deposited on the receiving tray of a high capacity stacker 38. A suitable sheet deflector isprovided at point 29 so that the sheet passes along the chosen one of a sheet paths 30 and 36.

In the case where a duplex copy is to be made, the sheet carrying its first-side image passes through transport rollers 27, 28 as before, but is deflected at point 39 along a lower sheet path 40 towards a pair of reversing rollers 41, 42. After a major portion of the sheet has been fed through reversing rollers 41, 42, along sheet path 43, and if necessary into vertical storage bin 44, the reversing rollers 41, 42 are stopped, and rotated in the opposite sense so as to refeed the sheet along a return paper path 45 from which it passes between transport rollers 28 and 46 to join the paper path normally followed by sheets initially fed from uppermost tray 24. The sheet then passes through common feed rollers 25 to receive a developed image on its other side at transfer station 15 of xerographic cassette 14. Thereafter, the duplex copy follows the upper paper path 26 as already described, with the option of feeding the sheet out into the top output tray 35, or the high capacity stacker 38.

The ESS 11 of the printer described above receives and processes the information which is to be printed, and also contains the machine controller, based on a microprocessor. A non-volatile memory (NVM) is used to store information such as machine settings (operating parameters), performance and service data, and diagnostic information. In the case of machine settings, the printer requires a different set of operating parameters for certain kinds of feedstock compared with the settings (the 'default' settings) used for standard feedstock such as A4 sheets of 80 g. $m^{-2}$ white paper. For each given type of feedstock, the relevant series of values for those operating parameters which need to be altered are stored in the NVM at an address representing that particular feedstock. When the signal is received by the controller that a given feedstock is to be used, the NVM is addressed by the signal to look up the relevant series of settings for the values of the operating parameters. By way of example, the chart below assumes that several different feedstocks (A-E) may be used, with a unique set of operating parameter settings for each feedstock (selected from settings a1-a6, b1-b3, c1 or c2, d1-d4, e1-e4, f1-f7)

| | a | b | c | d | e | f |
|---|---|---|---|---|---|---|
| A | a3 | b2 | c1 | d4 | e1 | f7 |
| B | a5 | b2 | c1 | d4 | e1 | f3 |
| C | a1 | b3 | c1 | d3 | e4 | f5 |
| D | a6 | b1 | c2 | d1 | e3 | f2 |

-continued

| | a | b | c | d | e | f |
|---|---|---|---|---|---|---|
| E | a4 | b1 | c1 | d2 | e2 | f4 |

Examples of operating parameters which may be set in this way includes such items as the time of starting to form a buckle in the copy sheet just prior to transfer of a developed image to the sheet, and the size of the buckle so formed. A sheet buckle is formed if the trailing edge of a sheet continues to be fed after the leading edge of the sheet has been stopped. This helps to remove any skew from the fed sheet, and assists in the acquisition of the leading edge of the sheet by, for example, a feed roller nip. Different feedstocks will require different settings of these parameters for optimum performance. Another example of a setting which can usefully be varied for different feedstocks is fuser temperature. Thus the values of a,b,c, etc., in the chart above represent such items as times and temperatures, as just mentioned, and also voltages, currents, illumination intensities, and possibly the positioning of sheet feed items such as feed rollers, deflectors or gates, or the switching on or off of certain functions of the machine.

The signal used to denote a given feedstock may be generated locally, i.e. at the printer by use of the manual controls, such as a keyboard or keypad of the printer, or remotely from the terminal generating the information to be printed in the case of a networked printer remote from the terminal. Alternatively, or in addition, the signal used to denote a feedstock can be provided automatically from the tray containing the feedstock. Thus, for example, a given tray can always be used for a special feedstock, so that whenever that tray is used, the relevant process parameters are set from the values stored in the NVM for that type of feedstock. Another way of 'recognizing' a special feedstock is to generate the appropriate signal whenever a particular size of sheet is put into a sheet tray. A further approach is to use a series of cassettes which may be received within one or more of the sheet trays, each cassette containing a particular kind of sheet, and each having its own built-in recognition means. One particularly effective recognition means is the use of a row of magnets and spaces on the cassette, arranged to cooperate with a row of reed switches associated with the sheet tray, such that on insertion of the cassette, the individual reed switches are operated or not operated in accordance with the presence or absence of a magnet on the cassette. In this way, with four reed switches and four magnet positions, sixteen different signals, denoting, if required sixteen different feedstock types, can be generated.

I claim:

1. Reprographic apparatus controlled by a controller including a microprocessor and memory, the apparatus including one or more sheet trays for supplying sheets which will receive images in use of the apparatus, wherein one or more operating parameters of the apparatus are selectively variable in accordance with differing characteristics of sheets to be used, characterized in that a set of values of the operating parameters are held in the memory for each of a series of different kinds of sheet, and that means are provided for setting the appropriate operating parameters to the values derived from the memory in accordance with the sheet characteristics, and wherein one of said operating parameters is the time starting to form a buckle in each of the sheets just prior to transfer of a developed image to each sheet.

2. The apparatus of claim 1 wherein the setting means is operable by a local or remote user of the apparatus.

3. The apparatus of claim 1 including means associated with at least one of the trays for recognising sheet characteristics and for operating the setting means to set the operating parameters.

4. The apparatus of claim 3 wherein sheets of specified characteristics are contained within a cassette, the cassette having identification means corresponding to the sheet characteristics, and the tray including means responsive to the identification means for setting the operating parameters on receiving the cassette.

5. In a printing apparatus for printing page images onto copy sheets including a microprocessor, and one or more copy sheet trays for supplying copy sheets which will receive images transferred thereto from a photoreceptor and fused thereto by a fuser, the improvement wherein one or more operating parameters of the apparatus are selectively variable in response to differing characteristics of the copy sheets contained within the trays, characterized by:

memory means for holding a set of values of the operating parameters for each of a series of different kinds of copy sheets;

means for generating a signal to said memory means indicating the particular kind of copy sheets placed in the trays; and control means for setting the appropriate operating parameters to the values desired from said memory means based upon the differing characteristics of the copy sheets, wherein one of said operating parameters is the time of starting to form a buckle in each of the copy sheets just prior to transfer of a developed image to each copy sheet.

6. The printing apparatus of claim 5, wherein said memory means is a non-volatile memory which stores information including operating parameters in the form of apparatus settings, performance and service data and diagnostic information.

7. The printing apparatus of claim 5, wherein one of said operating parameters is the temperature of the fuser.

8. The printing apparatus of claim 5, wherein a copy sheet holding cassette is placed within at least one of said trays.

9. In a printing apparatus for printing page images onto copy sheets including a microprocessor, and one or more copy sheet trays for supplying copy sheets which will receive images transferred thereto from a photoreceptor and fused thereto by a fuser, wherein one or more operating parameters of the apparatus are selectively variable in accordance with differing characteristics of the copy sheets contained within the trays, the improvement comprising:

non-volatile memory means for holding a set of values of the operating parameters for each of a series of different kinds of copy sheets;

means for generating a selected address signal to said non-volatile memory means indicating the particular kind of copy sheets to be used; and control means for setting the appropriate operating parameters to the values desired from said memory means in response to the selected address signal, the selected address signal being generated, at the choice of the operator, by any one of: a local user of the apparatus, a remote user of the apparatus, and automatic means associated with at least one of the trays for recognizing sheet characteristics.

* * * * *